US007067778B2

(12) United States Patent
Kim

(10) Patent No.: US 7,067,778 B2
(45) Date of Patent: Jun. 27, 2006

(54) MICROWAVEABLE COOKING CONTAINER AND MICROWAVE OVEN

(75) Inventor: Tae Jung Kim, Suwon-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 10/978,360

(22) Filed: Nov. 2, 2004

(65) Prior Publication Data

US 2005/0173421 A1 Aug. 11, 2005

(30) Foreign Application Priority Data

Jan. 9, 2004 (KR) ..... 10-2004-0001357

(51) Int. Cl.
*H05B 6/80* (2006.01)

(52) U.S. Cl. ..... 219/682; 219/730; 219/731; 219/734; 219/763; 99/DIG. 14; 426/241

(58) Field of Classification Search ..... 219/725–735, 219/681–685, 762–763; 426/241, 243; 99/DIG. 14, 99/451

See application file for complete search history.

(56) References Cited

U.S. PATENT DOCUMENTS

| | | | | |
|---|---|---|---|---|
| 4,906,806 | A * | 3/1990 | Levinson | 219/731 |
| 6,229,131 | B1 * | 5/2001 | Koochaki | 219/731 |
| 6,608,292 | B1 | 8/2003 | Barnes | |
| 6,768,088 | B1 * | 7/2004 | Kim | 219/685 |

* cited by examiner

*Primary Examiner*—Philip H. Leung
(74) *Attorney, Agent, or Firm*—Sughrue Mion, PLLC

(57) ABSTRACT

A microwave oven provided with a cooking container arranged in a cooking compartment for both steaming and grilling food. The cooking container includes a main body and a lid heated by high-frequency waves, a supporting member for selectively supporting the lid so as to rest on the upper surface of the main body, a rack selectively arrangable in the main body for supporting food so as to be steamed, and first and second heating members respectively covered on an outer surface of the bottom of the main body and an upper surface of the lid for generating heat by using the high-frequency waves. An inner surface of the bottom of the main body forms a first grill plane and a lower surface of the lid forms a second grill plane so that the food is grilled by the first and second grill planes when disposed so as to contact food.

23 Claims, 3 Drawing Sheets

MICROWAVEABLE COOKING CONTAINER AND MICROWAVE OVEN

CROSS-REFERENCE TO RELATED APPLICATION

This application claims the benefit of Korean Patent Application No. 2004-1357, filed on Jan. 9, 2004 in the Korean Intellectual Property Office, the disclosure of which is incorporated herein by reference.

BACKGROUND OF THE INVENTION

1. Field of the Invention

An apparatus consistent with the present invention relates to a microwave oven and, more particularly, to a microwave oven provided with a cooking container for both steaming and grilling food.

2. Description of the Related Art

Microwave ovens are used to cook or heat food located in a cooking compartment using high-frequency waves generated from a magnetron installed in an electric element compartment. Generally, in such a microwave oven, high-frequency waves irradiate the cooking compartment so as to repeatedly alter the molecular arrangement of water contained in food; thus, cooking the food by means of frictional heat generated between molecules of the water.

In order to cook food evenly in the cooking compartment, a rotating turntable for mounting food thereon or a stirrer for dispersing high-frequency waves is installed in the cooking compartment.

Various types of cooking containers can be positioned in the cooking compartment of the microwave oven so as to cook food by various methods using high-frequency waves that irradiate the cooking compartment.

For example, cooking containers that are specifically designed for steaming and grilling may be used. When food is required to be steamed, a container designed for steaming is irradiated with the high-frequency waves. Similarly, a container designed for grilling food is irradiated when grilled food is desired.

Since the conventional cooking containers used in the conventional microwave oven are designed for either steaming or grilling food, the microwave oven must include both a cooking container for steaming and a cooking container for grilling in order to perform both steaming and grilling functions.

Accordingly, the conventional microwave oven includes separate cooking containers for steaming and grilling. Thus, there is an increased cost of ownership since both cooking containers are needed, and more storage space is required for storing both the cooking containers.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Accordingly, an aspect of the invention is to provide a microwave oven which includes, installed in a cooking compartment, a cooking container for both steaming and grilling.

Another aspect of the invention is to provide a microwave oven comprising a cooking container that uniformly steams and grills food positioned therein when irradiated by high-frequency waves.

In accordance with the present invention, the above and other objects can be accomplished by the provision of a microwave oven comprising: an electric element compartment provided with a magnetron installed therein; a cooking compartment accepting high-frequency waves generated from the magnetron; and a cooking container, which is installed in the cooking compartment, that is irradiated by the high-frequency waves for selectively performing a steaming or grilling function.

The cooking container may include: a main body for accepting food to be cooked and heated by the high-frequency waves; a lid that is heated by the high-frequency waves and that is arranged in the main body so that an upper portion of the food contacts the lid; a supporting member for supporting the lid such that the lid rests on the upper surface of the main body; and a rack arranged in the main body for supporting the food so that the food is steamed.

The cooking container may further include: a first heating member covered on an outer surface of the bottom of the main body for generating heat by using the high-frequency waves; and a second heating member covered on an upper surface of the lid for generating heat by using the high-frequency waves.

Preferably, but not necessarily, the first and second heating members may be made of a material containing perlite particles in a designated amount so that they may be heated by the high-frequency waves.

An inner surface of the bottom of the main body may form a first grill plane and a lower surface of the lid may form a second grill plane so that the food is grilled by the first and second grill planes.

The rack may include: a surface, with a plurality of steam holes, for holding the food to be steamed; and a plurality of legs extended downwardly from the surface such that the rack separates the food from the bottom of the main body by a designated height.

The supporting member may include: a vertical frame which is inserted into the main body; a hanging frame outwardly extending from an upper end of the vertical frame and resting on an edge of the upper end of the main body; and a supporting frame inwardly extending from a lower end of the vertical frame for supporting the lid.

Preferably, but not necessarily, the main body and the lid may be made of a material having an excellent heat conductivity.

Further, an electric heater, separate from the high-frequency waves, may be installed in the cooking compartment for supplying heat to the cooking container.

BRIEF DESCRIPTION OF THE DRAWINGS

The above aspects, and other features and advantages of the present invention will become more apparent after reading the following detailed description of the exemplary embodiments when taken in conjunction with the accompanying drawings, in which.

DETAILED DESCRIPTION OF THE PREFERRED EMBODIMENTS

An illustrative, non-limiting embodiment of the present invention will be described in detail with reference to the accompanying drawings.

Figure 1:
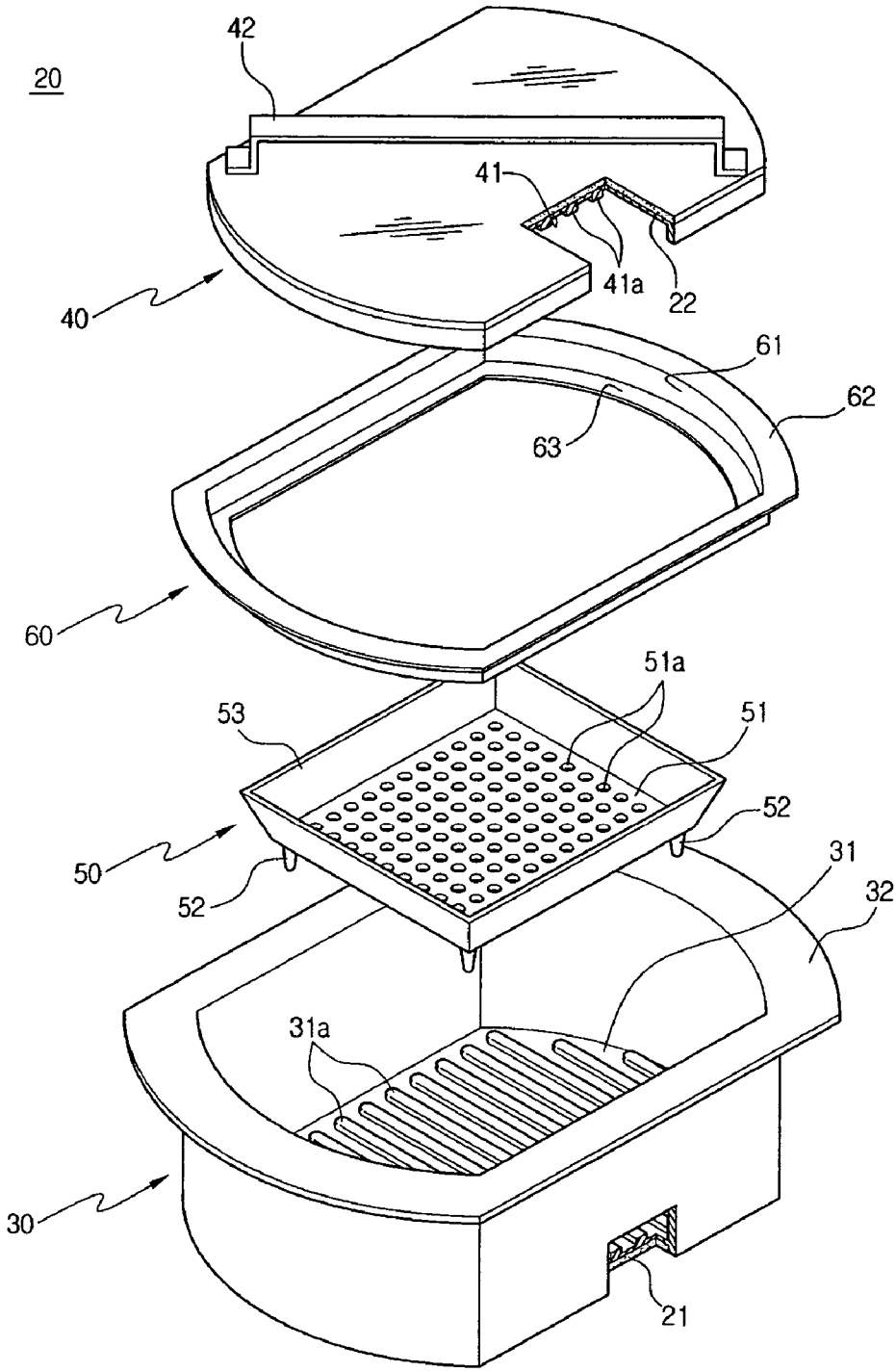
FIG. 1 is an exploded perspective view of a cooking container for grilling or steaming food, arranged in a cooking compartment of a microwave oven in accordance with the present invention.

FIG. 1 is an exploded perspective view of a cooking container for grilling or steaming food arranged in a cooking compartment of a microwave oven in accordance with the present invention.

As shown in FIG. 1, the cooking container 20, arranged in the cooking compartment of the microwave oven in accordance with the present invention, comprises a main body 30 and a lid 40 which, respectively, contact lower and upper surfaces of food so that the food located between the main body 30 and the lid 40 is grilled; a rack 50, which is installed in the main body 30 so that the food located on the rack 50 is steamed; and a supporting member 60.

The main body 30 includes a bottom and side walls having a uniform height, and food is placed in the main body 30 through an opening in the top portion thereof. A first grill plane 31 is formed on an inner surface of the bottom of the main body 30. The first grill plane 31 is provided with a plurality of convex portions 31*a* that are separated by a designated interval and contact the food; thus, allowing the lower portion of the food to be grilled.

A flange portion 32 is extended from the upper end of the main body 30 outwardly so that the supporting member 60 can rest on and be held by the flange portion 32. The flange portion 32 also serves as a handgrip.

A first heating member 21 for generating heat using high-frequency waves is covered on an outer surface of the bottom of the main body 30. The heat generated from the first heating member 21 is transmitted to the main body 30 so as to cook the food positioned therein. Accordingly, the main body 30 is made of a material having an excellent heat conductivity.

Preferably, but not necessarily, the first heating member 21 is made of a material containing perlite particles in a designated amount, and is covered on the outer surface of the bottom of the main body 30.

Here, the first heating member 21 may be covered on the entire outer surface of the main body 30 so that a large amount of the heat generated by the first heating member 21 is transmitted to the main body 30.

The lid 40 is sized such that it may be inserted into the the main body 30. Thus, when supporting member 60 is not attached to the upper part of the main body 30, the lid 40 contacts the upper surface of the food contained in the main body 30, thereby allowing the food to be grilled (with reference to FIG. 2). On the other hand, when supporting member 60 is attached to the upper part of the main body 30, the lid 40 rests on the upper end of the main body 30 through the supporting member 60, thus allowing the food to be steamed (with reference to FIG. 3).

A second grill plane 41 is formed on a lower surface of the lid 40. The second grill plane 41 is provided with a plurality of convex portions 41*a* that are separated by a designated interval and contact the food.

A second heating member 22, for generating heat using high-frequency waves, is covered on an upper surface of the lid 40, thus heating the lid 40. Accordingly, in the same manner as the main body 30, the lid 40 is made of a material having excellent heat conductivity.

In the same manner as the first heating member, the second heating member 22 is made of a material containing perlite particles in a designated amount, and is covered on the upper surface of the lid 40. A handle 42 is attached to the upper surface of the lid 40 so that a user simply lifts the lid 40 using the handle 42.

The rack 50 serves to separate the food to be cooked from the bottom of the main body 30 by a designated height, thus allowing the food to be steamed by means of steam generated by heating water contained in the main body 30. The rack includes a surface 51, with a plurality of steam holes 51*a*, for holding the food and legs 52 extended downwardly from the corners of the surface 51. In order to hold the food better, an upward extended portion 53 is formed on the edge of the surface 51.

Accordingly, when the rack 50 is installed in the main body 30, the surface 51 of the of the rack 50 is separated from the bottom of the main body 30 by a designated height by the legs 52 of the rack 50 so that the food on the surface 51 may be steamed.

The supporting member 60, which may be inserted into an inner circumference of the main body 30 for supporting the lid 40, includes a vertical frame 61, a hanging frame 62 outwardly extending from an upper end of the vertical frame 61 and resting on the flange portion 32 of the main body 30, and a supporting frame 63 inwardly extending from a lower end of the vertical frame 61 for supporting the lower end of the lid 40.

Accordingly, when the supporting member 60 is mounted on the upper end of the main body 30, the hanging frame 62 rests on the flange portion 32 of the main body 30 such that the hanging frame 62 is positioned on the inner circumference of the upper end of the main body 30. When the lid 40 is mounted on the supporting member 60, the lower end of the lid 40 is supported by the supporting frame 63, thus covering the upper surface of the main body 30.

Figure 2:
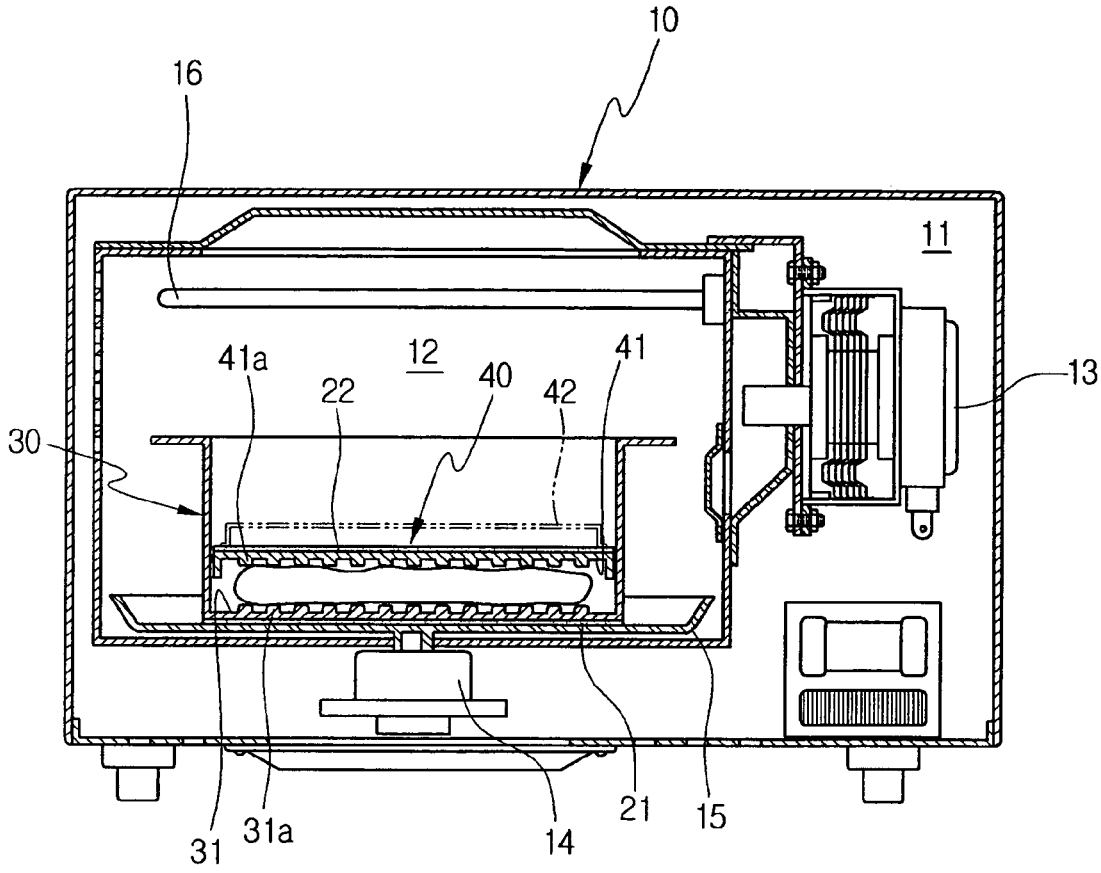
FIG. 2 is a sectional view of the microwave oven, in which food, contained in the cooking container of FIG. 1 and arranged in the cooking compartment, is grilled in accordance with the present invention.

FIG. 2 is a sectional view of the microwave oven, in which food, contained in a cooking container of FIG. 1 and arranged in the cooking compartment, is grilled in accordance with the present invention.

As shown in FIG. 2, the microwave oven 10 of the present invention is formed in approximately a box shape (but can include other shapes) and comprises an electric element compartment 11 and a cooking compartment 12.

Various electric elements, such as a magnetron 13, for generating high-frequency waves are installed in the electric element compartment 11, and a turntable 15 rotated at a low speed by an operating motor 14 is located in the cooking compartment 12, thus allowing the food mounted thereon to be cooked by means of the high-frequency waves generated from the magnetron 13. Further, an electric heater 16, for generating heat so as to cook the food separately from the above cooking of the food by means of the high-frequency waves, may be installed in the cooking compartment 12.

Accordingly, when the microwave oven 10 is operated with the food mounted on the turntable 15, the turntable 15 is rotated at a low speed such that the food on the turntable 15 is cooked by the high-frequency waves generated from the magnetron 13.

When the food is placed in the main body 30 and then covered with the lid 40 in order to grill the food 30 in the cooking compartment 12 using the cooking container 20, a lower portion of the food contacts the first grill plane 31 formed on the inner surface of the bottom of the main body 30 and an upper portion of the food contacts the convex portions 41*a* of the second grill plane 41 formed on the lower surface of the lid 40 inserted into the main body 30.

When the microwave oven 10 is operated as described above, the first and second heating members 21 and 22 generate heat by means of the high-frequency waves generated by the magnetron 13, thus heating the main body 30 and the lid 40. Thereby, the food (for example, meat, sausage, and fish to name just a few) contacting the first and second grill planes 31 and 41 is grilled.

Here, the cooking container 20 may be mounted on a separate holder rather than the turntable 15 in the cooking compartment 12 so that the food contained in the cooking container 20 is cooked without the rotation of the cooking container 20.

Figure 3:
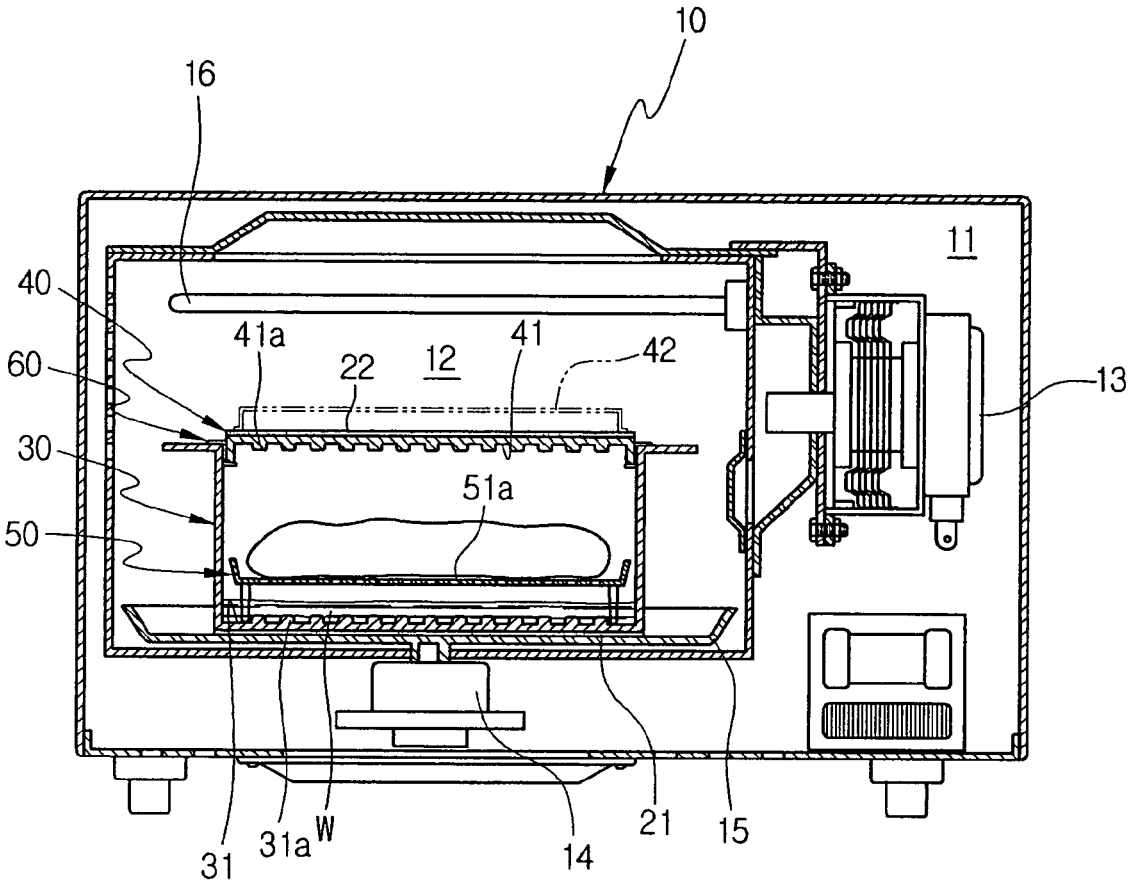
FIG. 3 is a sectional view of the microwave oven, in which food, contained in the cooking container of FIG. 1 and arranged in the cooking compartment, is steamed in accordance with the present invention.

FIG. 3 is a sectional view of the microwave oven, in which food, contained in the cooking container of FIG. 1 and arranged in the cooking compartment, is steamed in accordance with the present invention.

In order to steam food contained in the cooking container 20 in the cooking compartment 12, water (W), in a designated amount required for steaming, is poured into the main body 30 and the rack 50 is positioned in the main body 30. Here, the height of the water (W) poured into the main body 30 is lower than the height of the legs 52 of the rack 50 so that the water (W) does not run over the surface 51.

After food to be steamed is positioned on the surface 51 of the rack 50 and the supporting member 60 is mounted on the upper end of the main body 30 under the conditions described above, the lid 40 is mounted on the supporting member 60. Thus, as shown in FIG. 3, the food is located on the surface 51 such that the food is not submerged under the water (W), and the lid 40 is located on the upper end of the main body 30 such that the lid 40 is supported by the supporting member 60.

When the microwave oven 10 is operated under the above conditions, the first and second heating members 21 and 22 generate heat by means of the high-frequency waves generated from the magnetron 13, thus heating the main body 30 and the lid 40. Thereby, the food located on the rack 50 is steamed.

In steam cooking, a gap or hole which prevents the pressure of steam generated from the inside of the main body 30 from increasing excessively may be disposed between the supporting member 60 and the upper end of the main body 30 so that steam leaks out through the gap or hole.

As apparent from the above description, a microwave oven in accordance with the present invention comprises a cooking container arranged in a cooking compartment for both steaming and grilling food by means of high-frequency waves so that the food can be selectively steamed or grilled by a single cooking container, thus eliminating cost taken to have both steaming and grilling functions, and providing to users convenience in storing and using the cooking container.

Although the exemplary embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven comprising:

an electric element compartment provided with a magnetron installed therein;

a cooking compartment accepting high-frequency waves generated from the magnetron; and a cooking container, installed in the cooking compartment and adapted to be heated by the high-frequency waves, for selectively performing a steaming or grilling function, wherein the cooking container includes:

a main body for accepting food to be cooked and comprising a member for generating heat by using the high-frequency waves;

a lid comprising a member for generating heat by using the high-frequency waves and the lid arranged to cooperate with the main body;

a supporting member for selectively supporting the lid such that the lid rests on the upper surface of the main body; and a rack adapted to selectively be arranged in the main body for supporting the food so that the food may be steamed.

2. The microwave oven according to claim 1, wherein the rack includes:

a surface, with a plurality of steam holes, for holding the food to be steamed; and a plurality of legs extended downwardly from the surface, wherein the legs dispose the surface at a predetermined height from the bottom of the main body.

3. The microwave oven according to claim 1, wherein the main body and the lid are made of a material having an excellent heat conductivity.

4. The microwave oven according to claim 3, wherein an electric heater for supplying heat to the cooking container is installed in the cooking compartment.

5. A microwave oven comprising:

an electric element compartment provided with a magnetron installed therein;

a cooking compartment accepting high-frequency waves generated from the magnetron; and a cooking container, installed in the cooking compartment and adapted to be heated by the high-frequency waves, for selectively performing a steaming or grilling function, wherein the cooking container includes:

a main body for accepting food to be cooked and adapted to be heated by the high-frequency waves;

a lid adapted to be heated by the high-frequency waves and arranged to cooperate with the main body;

a supporting member for selectively supporting the lid such that the lid rests on the upper surface of the main body;

a rack adapted to selectively be arranged in the main body for supporting the food so that the food may be steamed;

a first heating member covered on an outer surface of the bottom of the main body for generating heat by using the high-frequency waves; and a second heating member covered on an upper surface of the lid for generating heat by using the high-frequency waves.

6. The Microwave oven according to claim 5, wherein the first and second heating members are made of a material containing a predetermined amount of perlite particles so that they may be heated by the high-frequency waves.

7. A microwave oven comprising:

an electric element compartment provided with a magnetron installed therein;

a cooking compartment accepting high-frequency waves generated from the magnetron; and a cooking container, installed in the cooking compartment and adapted to be heated by the high-frequency waves, for selectively performing a steaming or grilling function, wherein the cooking container includes:

a main body for accepting food to be cooked and adapted to be heated by the high-frequency waves;

a lid adapted to be heated by the high-frequency waves and arranged to cooperate with the main body;

a supporting member for selectively supporting the lid such that the lid rests on the upper surface of the main body; and a rack adapted to selectively be arranged in the main body for supporting the food so that the food may be steamed, and wherein an inner surface of the bottom of the main body forms a first grill plane and a lower surface of the lid forms a second grill plane so that food may be grilled by the first and second grill planes.

8. A microwave oven comprising:

an electric element compartment provided with a magnetron installed therein;

a cooking compartment accepting high-frequency waves generated from the magnetron; and a cooking container, installed in the cooking compartment and adapted to be heated by the high-frequency waves, for selectively performing a steaming or grilling function, wherein the cooking container includes:

a main body for accepting food to be cooked and adapted to be heated by the high-frequency waves;

a lid adapted to be heated by the high-frequency waves and arranged to cooperate with the main body;

a supporting member for selectively supporting the lid such that the lid rests on the upper surface of the main body; and a rack adapted to selectively be arranged in the main body for supporting the food so that the food may be steamed, and wherein the supporting member includes:

a vertical frame selectively insertable into the main body;

a hanging frame outwardly extending from an upper end of the vertical frame for selectively resting on an edge of the upper end of the main body; and a supporting frame inwardly extending from a lower end of the vertical frame for selectively supporting the lid.

9. A microwave oven comprising:

an electric element compartment provided with a magnetron installed therein;

a cooking compartment accepting high-frequency waves generated from the magnetron; and a cooking container, installed in the cooking compartment for cooking food contained in the cooking compartment, that includes a main body comprising a member for generating heat by using the high-frequency waves and a lid comprising a member for generating heat by using the high-frequency waves, wherein the lid is configured to be selectively insertable into the main body so that the food may be grilled, or rested on the upper end of the main body so that the food may be steamed.

10. The microwave oven according to claim 9, wherein the cooking container further includes:

a supporting member for supporting the lid such that the lid selectively is rested on the upper surface of the main body; and a rack arranged in the main body for supporting the food at a predetermined height above a bottom of the main body so that the food may be steamed by water contained in the main body.

11. The microwave oven according to claim 10, wherein the rack includes:

a surface, with a plurality of steam holes, for holding the food to be steamed; and a plurality of legs extended downwardly from the surface, wherein the legs are configured to dispose the surface at a predetermined height from the bottom of the main body.

12. A microwave oven comprising:

an electric element compartment provided with a magnetron installed therein;

a cooking compartment accepting high-frequency waves generated from the magnetron; and a cooking container, installed in the cooking compartment for cooking food contained in the cooking compartment, that includes a main body and a lid adapted to be heated by the high-frequency waves, wherein the lid is configured to be selectively insertable into the main body so that the food may be grilled, or rested on the upper end of the main body so that the food may be steamed, wherein the cooking container further includes:

a supporting member for supporting the lid such that the lid selectively is rested on the upper surface of the main body;

a rack arranged in the main body for supporting the food at a predetermined height above a bottom of the main body so that the food may be steamed by water contained in the main body;

a first heating member covered on an outer surface of the bottom of the main body for generating heat by using the high-frequency waves; and a second heating member covered on an upper surface of the lid for generating heat by using the high-frequency waves.

13. The microwave oven according to claim 12, wherein an inner surface of the bottom of the main body forms a first grill plane and a lower surface of the lid forms a second grill plane so that the food may be grilled by the first and second grill planes.

14. A microwave oven comprising:

an electric element compartment provided with a magnetron installed therein;

a cooking compartment accepting high-frequency waves generated from the magnetron; and a cooking container, installed in the cooking compartment for cooking food contained in the cooking compartment, that includes a main body and a lid adapted to be heated by the high-frequency waves, wherein the lid is configured to be selectively insertable into the main body so that the food may be grilled, or rested on the upper end of the main body so that the food may be steamed, wherein the cooking container further includes:

a supporting member for supporting the lid such that the lid selectively is rested on the upper surface of the main body; and a rack arranged in the main body for supporting the food at a predetermined height above a bottom of the main body so that the food may be steamed by water contained in the main body; and wherein the supporting member includes:

a vertical frame selectively insertable into the main body;

a hanging frame outwardly extending from an upper end of the vertical frame for selectively resting on an edge of the upper end of the main body; and a supporting frame inwardly extending from a lower end of the vertical frame for selectively supporting the lid.

15. A microwaveable cooking container comprising:

a main body for accepting food to be cooked and comprising a member for generating heat by using high-frequency waves;

a lid comprising a member for generating heat by using the high-frequency waves and the lid arranged to cooperate with the main body;

a supporting member for selectively supporting the lid such that the lid rests on the upper surface of the main body; and a rack adapted to selectively be arranged in the main body for supporting the food so that the food may be steamed.

16. The microwaveable cooking container according to claim 15, wherein the rack includes:

a surface, with a plurality of steam holes, for holding the food to be steamed; and a plurality of legs extended downwardly from the surface, wherein the legs dispose the surface at a predetermined height from the bottom of the main body.

17. The microwaveable cooking container according to claim 15, wherein the main body and the lid are made of a material having an excellent heat conductivity.

18. A microwaveable cooking container comprising:

a main body for accepting food to be cooked and adapted to be heated by high-frequency waves;

a lid adapted to be heated by the high-frequency waves and arranged to cooperate with the main body;

a supporting member for selectively supporting the lid such that the lid rests on the upper surface of the main body;

a rack adapted to selectively be arranged in the main body for supporting the food so that the food may be steamed;

a first heating member covered on an outer surface of a bottom of the main body for generating heat by using the high-frequency waves; and a second heating member covered on an upper surface of the lid for generating heat by using the high-frequency waves.

19. The microwaveable cooking container according to claim 18, wherein the first and second heating members are made of a material containing a predetermined amount of perlite particles so that they may be heated by the high-frequency waves.

20. A microwaveable cooking container comprising:

a main body for accepting food to be cooked and adapted to be heated by high-frequency waves;

a lid adapted to be heated by the high-frequency waves and arranged to cooperate with the main body;

a supporting member for selectively supporting the lid such that the lid rests on the upper surface of the main body; and a rack adapted to selectively be arranged in the main body for supporting the food so that the food may be steamed, wherein an inner surface of the bottom of the main body forms a first grill plane and a lower surface of the lid forms a second grill plane so that food may be grilled by the first and second grill planes.

21. A microwaveable cooking container comprising:

a main body for accepting food to be cooked and adapted to be heated by high-frequency waves;

a lid adapted to be heated by the high-frequency waves and arranged to cooperate with the main body;

a supporting member for selectively supporting the lid such that the lid rests on the upper surface of the main body; and a rack adapted to selectively be arranged in the main body for supporting the food so that the food may be steamed, wherein the supporting member includes:

a vertical frame selectively insertable into the main body;

a hanging frame outwardly extending from an upper end of the vertical frame for selectively resting on an edge of the upper end of the main body; and a supporting frame inwardly extending from a lower end of the vertical frame for selectively supporting the lid.

22. A microwave oven comprising:

an electric element compartment provided with a magnetron installed therein;

a cooking compartment accepting high-frequency waves generated from the magnetron; and a cooking container, installed in the cooking compartment and adapted to be heated by the high-frequency waves, for selectively performing a steaming or grilling function, wherein the cooking container includes:

a main body for accepting food to be cooked and adapted to be heated by the high-frequency waves;

a lid adapted to be heated by the high-frequency waves and arranged to cooperate with the main body;

a supporting member for selectively supporting the lid such that the lid rests on the upper surface of the main body; and a rack adapted to selectively be arranged in the main body for supporting the food so that the food may be steamed, and wherein the main body is adapted such that the lid is insertable into the main body when the supporting member is not supporting the lid.

23. A microwaveable cooking container comprising:

a main body for accepting food to be cooked and adapted to be heated by high-frequency waves;

a lid adapted to be heated by the high-frequency waves and arranged to cooperate with the main body;

a supporting member for selectively supporting the lid such that the lid rests on the upper surface of the main body; and a rack adapted to selectively be arranged in the main body for supporting the food so that the food may be steamed, wherein the main body is adapted such that the lid is insertable into the main body when the supporting member is not supporting the lid.

* * * * *